US005932069A

United States Patent [19]

Kuosa et al.

[11] Patent Number: 5,932,069

[45] Date of Patent: Aug. 3, 1999

[54] PAPER MACHINE ROLL WITH HEATED ENDS IN A SOFT CALENDER OR SUPERCALENDER AND METHOD FOR CALENDERING A WEB

[75] Inventors: Harri Kuosa, Järvenpää; Markku Kyytsönen, Mäntsälä; Rob Stapels, Jäniksenlinna; Vesa Ijäs, Viiala; Jouko Meronen, Mäntsälä; Risto Vainio, Tuusula; Markku Kirvesmäki, Vantaa, all of Finland

[73] Assignee: Valmet Corporation, Helsinki, Finland

[21] Appl. No.: 08/822,010

[22] Filed: Mar. 24, 1997

[30] Foreign Application Priority Data

Mar. 22, 1996 [FI] Finland ..... 960180

[51] Int. Cl.[6] ..... D21G 1/02

[52] U.S. Cl. ..... 162/199; 100/38; 100/329; 100/334; 162/206; 162/361; 162/375; 492/46

[58] Field of Search ..... 162/359.1, 206, 162/361, 375, 199; 100/38, 155 R, 323, 327, 329, 332, 334; 492/46

[56] References Cited

U.S. PATENT DOCUMENTS

| | | | |
|---|---|---|---|
| 4,229,950 | 10/1980 | Fessenden | 492/46 |
| 4,425,489 | 1/1984 | Pav et al. | 219/10.49 |
| 4,610,617 | 9/1986 | Christ et al. | 425/143 |
| 4,730,374 | 3/1988 | Neuhoffer et al. | 492/46 |
| 5,076,891 | 12/1991 | Link et al. | 162/206 |
| 5,156,086 | 10/1992 | Kiema et al. | 162/206 |
| 5,277,690 | 1/1994 | Schiel | 492/46 |
| 5,289,766 | 3/1994 | Conrad et al. | 162/361 |
| 5,571,066 | 11/1996 | Kayser | 492/46 |

FOREIGN PATENT DOCUMENTS

| | | |
|---|---|---|
| 0554698 | 8/1993 | European Pat. Off. . |
| 9207957 | 9/1992 | Germany . |

*Primary Examiner*—Karen M. Hastings
*Attorney, Agent, or Firm*—Steinberg & Raskin, P.C.

[57] ABSTRACT

A paper machine roll, in particular for a soft calender or supercalender, which includes a metal frame, roll ends, and shafts. The frame is coated with a polymer coating over at least a middle area or central region thereof while lateral regions may optionally remain uncoated. In order to equalize a difference in temperature between the roll ends and the optionally non-coated lateral regions of the metal frame, on one hand, and the coated central region area of the roll, on the other hand, an arrangement for equalizing the difference in temperature is provided by heating the roll ends and the optionally non-coated lateral regions of the metal frame.

13 Claims, 2 Drawing Sheets

PAPER MACHINE ROLL WITH HEATED ENDS IN A SOFT CALENDER OR SUPERCALENDER AND METHOD FOR CALENDERING A WEB

FIELD OF THE INVENTION

The present invention relates to a paper machine roll, in particular a roll for a soft calender or supercalender, which comprises a metal frame, ends, and shafts, and a polymer coating applied onto the frame of the roll.

The present invention also relates to a method for calendering a material web by passing the web through a calendering nip defined by a calender roll and a back-up roll whereby the calender roll comprises a metal frame, ends, and shafts, and a polymer coating applied onto at least a central region of the frame of the roll.

BACKGROUND OF THE INVENTION

Coated rolls are used in paper machines and in paper finishing devices in substantially different applications. As examples of such applications, soft rolls for soft calenders and supercalenders, and equivalent, should be mentioned. Usually the soft coatings on rolls are made of organic polymers or mixtures thereof, which often also include inorganic elements. The soft coatings on rolls are often made of a composite structure, which comprises layers made of different materials.

In calenders, such as soft calenders or supercalenders, the roll nips are so-called soft nips, i.e., nips in which a hard roll is fitted as a pair with an elastically resilient roll. Elastically resilient rolls have been so-called paper-filled rolls, i.e., rolls that consist of paper strips fitted as layers one above the other, but at present various types of polymer-coated rolls are used more and more commonly as the resilient rolls.

The coating on a polymner-coated roll is an insulator, and when the roll revolves, the polymer coating produces thermal energy as a result of the nip effect and as a result of compression and bending, and this thermal energy is partly conducted into the metal-mantle frame of the roll. The surface temperature of the polymer can be up to about 80° C. during calendering. The metal mantle of the roll expands because of the thermal energy, which also affects the quality of the paper to be calendered. From the roll mantle, heat is also conducted to the roll ends and to the shafts, which are not placed inside the insulating polymer coating, in which connection a difference in temperature arises between the middle portions and the lateral portions of the roll, as a result of which the roll becomes distorted and somewhat "barrel-shaped". This phenomenon is not desirable in view of the calendering process or of the use of the coatings, in particular in view of their service life.

OBJECTS AND SUMMARY OF THE INVENTION

It is an object of the present invention to provide a roll in which the distortion described above arising from the flow of heat does not occur in the roll frame and thus the quality of calendering remains at the desired level.

It is another object of the present invention to provide a new and improved roll for use in a calender or supercalender.

It is yet another object of the present invention to provide a new and improved method for calendering a web in which the service life of the calender roll is extended and its operation is improved.

In view of achieving the objects stated above and others, the roll in accordance with the invention includes an arrangement for equalizing the difference in temperature between the coated middle area of the roll on one hand and the ends of the roll and the non-coated areas of the lateral areas of the metal frame (if present) on the other hand, which is arranged in connection with the roll ends and with the non-coated lateral areas of the metal frame, or otherwise operative at the roll ends and the non-coated lateral areas of the metal frame.

According to one exemplifying embodiment of the invention, the end areas of the polymer-coated roll are insulated by means of an insulating material, such as polyurethane or an equivalent, in which connection the conduction of heat to the end areas and through the end areas to the air is minimized and the difference in temperature between the end areas and the middle areas is equalized. In this embodiment, the diameter of the roll remains substantially as desired and the roll does not assumed a distorted shape.

According to another exemplifying embodiment of the invention, in view of minimizing the conduction of heat to the end areas of the roll and through the end areas to the air, and thereby equalize the difference in temperature between the end areas and the middle areas, heating means are utilized to heat the end areas of the polymer-coated roll, for example induction heating.

In the method for calendering a web by passing the web through a calendering nip defined by a calender roll and a back-up roll, the calender roll includes a cylindrical metal frame, roll ends arranged at each end of the frame, shafts each coupled to a respective one of the roll ends, and a polymer coating applied to at least a central region of the frame between the roll ends (while lateral regions of the metal frame optionally remain uncoated). As noted above, a difference in temperature is formed during operation between the coated central region of the frame and the optionally uncoated lateral regions of the frame and the roll ends. To this end, the method entails equalizing the temperature difference between the coated central region of the frame and uncoated lateral regions of the frame and the roll ends. This is achieved by, e.g., covering the roll ends and the uncoated lateral regions of the frame with an insulating material, heating the roll ends and the uncoated lateral regions of the frame and/or passing a heated medium through bores in the roll ends and the shafts to thereby heat the roll ends and the uncoated lateral regions of the frame.

In the following, the invention will be described in more detail with reference to the figures in the accompanying drawing. However, it should be recognized that the invention is not in any way strictly confined to the details of the illustrated embodiments.

BRIEF DESCRIPTION OF THE DRAWINGS

Additional objects of the invention will be apparent from the following description of the preferred embodiment thereof taken in conjunction with the accompanying non-limiting drawings, in which.

DETAILED DESCRIPTION OF THE PREFERRED EMBODIMENTS

Figure 1:
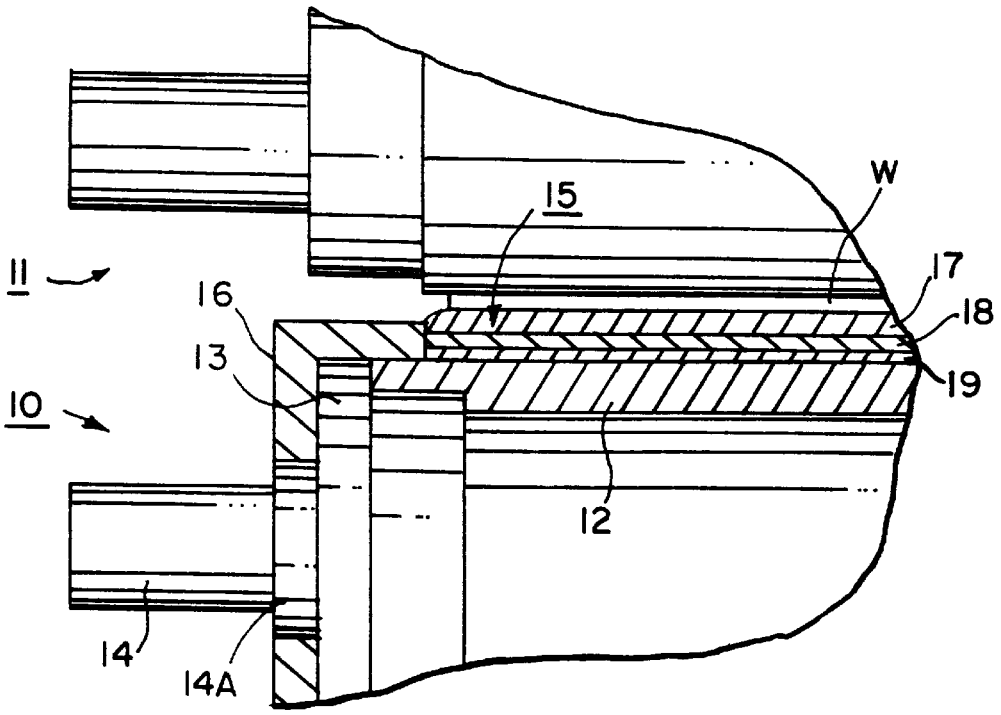
FIG. 1 is a partial schematic illustration of an exemplifying embodiment of a roll in accordance with the present invention and a backup roll of this roll.

Referring to FIGS. 1–3B wherein like reference numerals refer to the same or similar elements, in FIG. 1 a polymer-coated roll in accordance with the invention is denoted by reference numeral 10 and a backup roll which forms a calendering nip with the polymer-coated roll 10 is denoted by reference numeral 11. A paper web W runs through the calendering nip between the rolls 10,11 during use. The roll 10 comprises a cylindrical metal mantle 12, roll ends 13, and shafts 14 for supporting the roll 10. The polymer coating on the roll 10 is denoted by reference numeral 15 and in this embodiment, does not completely cover the metal mantle 12, but covers at least a central region thereof so that lateral regions of the metal mantle 12 remain uncoated. The coating 15 consists of one or more coating layers 17,18,19.

According to the exemplifying embodiment of the invention shown in FIG. 1, insulating means such as insulating material 16 is arranged in connection with the roll ends 13. The insulating material 16 covers the roll ends 13 so that the insulating material 16 extends from the edge of the coating 15 to a shoulder 14A of a respective one of the shafts 14, in which case substantially the entire roll end 13 is insulated. For example, as shown in FIG. 1, the insulating material 16 at one side of the roll 10 thus extends along a uncoated portion of the metal mantle 12 over a front surface of the roll end 13 and along a side face of the roll end 13 into engagement with the shoulder 14A of the respective shaft 14. In this manner, the difference in temperature between the roll ends 13 and the middle areas provided with a coating 15 is equalized and the shape of the roll 10 remains substantially as desired. The insulating material 16 can be polyurethane or any other suitable insulating material.

Figure 2:
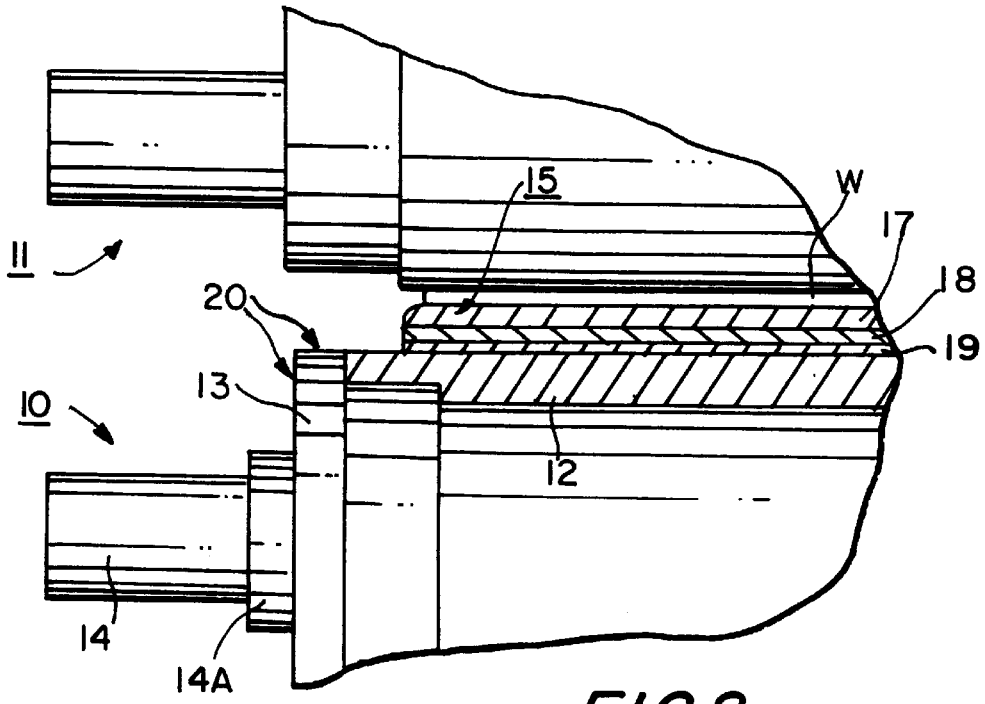
FIG. 2 is a partial schematic illustration of a second exemplifying embodiment of a roll in accordance with the present invention and a backup roll of the roll.

In FIG. 2, the polymer-coated roll is also denoted by reference numeral 10 and the backup roll is denoted by reference numeral 11. The paper web W runs through the calendering nip between the rolls 10,11. The roll 10 comprises a metal mantle 12, roll ends 13, and shafts 14. The polymer coating on the roll 10 is also denoted by reference numeral 15 and includes coating layers 17,18,19. According to the second exemplifying embodiment of the invention shown in FIG. 2, the non-coated end areas of the roll 10 provided with a polymer coating 15 are heated, the heating effect being represented by the arrows 20, for example induction heating. By means of the heating arrangement 20, the roll ends 13 and the non-coated lateral areas of the metal frame 12 are heated so that the difference in temperature between the roll ends 13 and the coated middle areas is equalized, e.g., the temperature of the roll ends 13 and non-coated lateral areas of the metal frame 12 is raised to approximate the temperature of the coated middle areas of the roll 10.

Figure 3B:
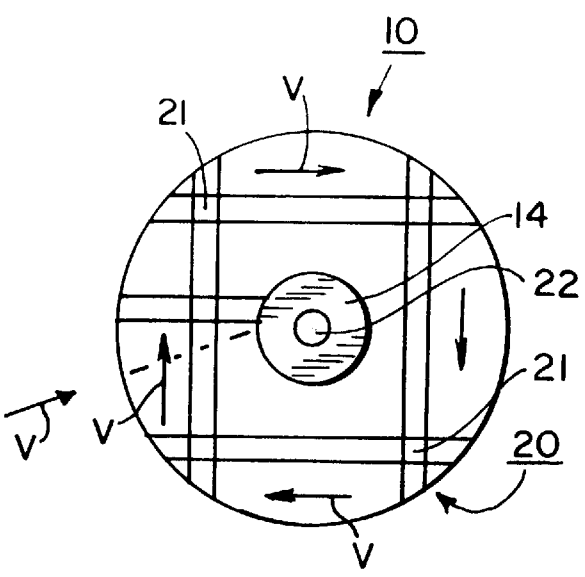
FIGS. 3B is a partial schematic illustration of the third exemplifying embodiment of a roll in accordance with the present invention shown in FIG. 3A viewed from the left side of FIG. 3A.
Figure 3A:
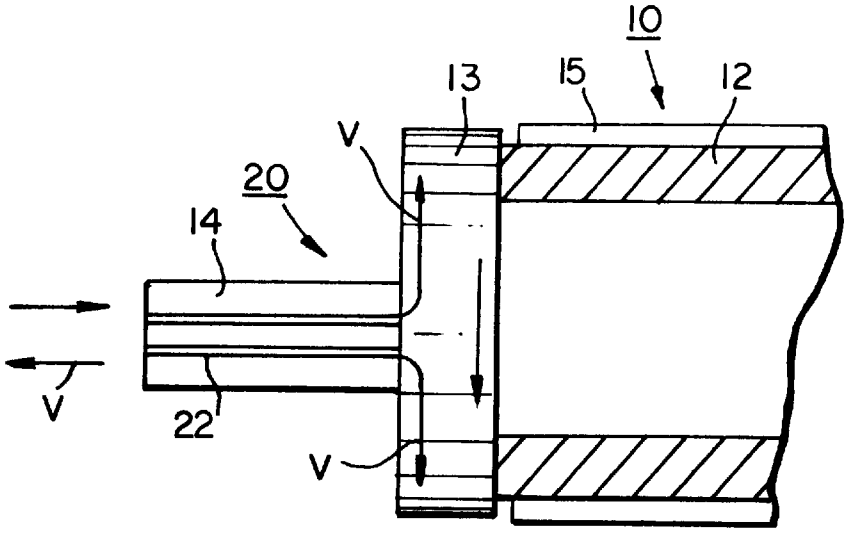
FIGS. 3A is a partial schematic illustration of a third exemplifying embodiment of a roll in accordance with the present invention.

In FIGS. 3A and 3B, the polymer-coated roll is denoted by reference numeral 10 and comprises a metal mantle 12, roll ends 13, and shafts 14. The polymer coating on the roll 10 is denoted by reference numeral 15. According to this exemplifying embodiment of the invention shown in FIGS. 3A and 3B, a water heating arrangement is arranged to heat the non-coated end areas 13 of the roll 10 provided with a polymer coating 15, the water heating arrangement being represented schematically by 20. By means of the water heating arrangement 20, the roll ends 13 and the non-coated lateral areas of the metal frame 12 are heated so that the difference in temperature between the roll ends 13 and the coated 15 middle areas of the roll is equalized.

The heating water, which is denoted with the arrows V, is passed to circulate into one or more bores 21 in the roll ends 13, for example, through bores 22 that are formed in shafts 14. A heating arrangement 20 is provided in connection with each roll end 13 of the roll 10. The heating water V can also be supplied through one end only, in which case the water is passed into the opposite end along an insulated peripheral bore that has been made into the roll frame 12. The temperature of the heating water V is, for example, about 10° C. hotter than the temperature of the roll. Other heating media can be used instead of water.

The examples provided above are not meant to be exclusive. Many other variations of the present invention would be obvious to those skilled in the art, and are contemplated to be within the scope of the appended claims. For example, it is pointed out that in the illustrations of FIGS. 1, 2, 3A and 3B, the metal mantle frame 12 is not completely covered so that there are uncoated lateral regions or areas of the metal frame 12. However, the invention is equally applicable in embodiments wherein the metal frame 12 is entirely covered by the polymer coating 15 whereby the insulating material or application of heat would be directed solely to the roll ends. The specific coated portions of the metal frame and the uncoated portions of the metal frame may be provided in view of the dimensions of the web, i.e., the coated portion of the metal frame should be coextensive with the width of the web to thereby define the calendering nip with the back-up roll.

We claim:

1. In a method for calendering a web including the steps of:

providing a calender roll including a cylindrical metal frame, roll ends arranged at each end of the frame, shafts each coupled to a respective one of the roll ends, and a polymer coating applied to at least a central region of the frame between the roll ends whereby lateral regions of the frame optionally remain uncoated, arranging a back-up roll to form a calendering nip with the coated central region of the calender roll, and passing the web through the calendering nip between the back-up roll and the coated central region of the calender roll such that the coated central region is heated solely as a result of the formation of the nip with the back-up roll and the coated central region is at a higher temperature than the roll ends and optionally uncoated lateral regions to thereby cause heat to be conducted from the coated central region to the roll ends and optionally uncoated lateral regions of the frame and a difference in temperature between the coated central region of the frame and the roll ends and optionally uncoated lateral regions of the frame to be formed solely in view of the heating of the coated central region as a result of the formation of the nip with the back-up roll, the improvement comprising the step of:

heating the roll ends to increase the temperature of the roll ends and optionally uncoated lateral regions of the frame and thereby equalizing the temperature difference between the coated central region of the frame and the roll ends and the optionally uncoated lateral regions of the frame which would be formed solely in view of the heating of the coated central region as a result of the formation of the nip with the back-up roll and reducing the conduction of heat from the coated central region to the roll ends and optionally uncoated lateral regions of the frame.

2. The method of claim 1, wherein the lateral regions of the frame are uncoated, further comprising the step of heating the uncoated lateral regions of the frame.

3. The method of claim 1, wherein the step of heating the roll ends comprises the step of passing a heated medium through bores in the roll ends.

4. The method of claim 2, wherein the roll ends and uncoated lateral regions of the frame are heated by an induction heating device.

5. The method of claim 3, further comprising the step of:

directing the heating medium through a bore in each of the shafts into the bores in a respective one of the roll ends.

6. A method for calendering a web, comprising the steps of:

providing a calender roll including a cylindrical metal frame, roll ends arranged at each end of the frame, shafts each coupled to a respective one of the roll ends, and a polymer coating applied to at least a central region of the frame between the roll ends whereby lateral regions of the frame optionally remain uncoated, arranging a back-up roll to form a calendering nip with the coated central region of the calender roll, passing the web through the calendering nip between the back-up roll and the coated central region of the calender roll, the coated central region being heated solely as a result of the formation of the nip with the back-up roll, and heating the roll ends to increase the temperature of the rolls ends and optionally uncoated lateral regions of the frame and thereby reduce conduction of heat from the coated central region of the frame to the roll ends and the optionally uncoated lateral regions of the frame.

7. The method of claim 6, wherein the lateral regions of the frame are uncoated, further comprising the step of heating the uncoated lateral regions of the frame.

8. The method of claim 6, wherein the step of heating the roll ends comprises the step of passing a heated medium through bores in the roll ends.

9. The method of claim 7, wherein the roll ends and uncoated lateral regions of the frame are heated by an induction heating device.

10. The method of claim 8, further comprising the step of:

directing the heating medium through a bore in each of the shafts into the bores in a respective one of the roll ends.

11. In a roll nip of a paper machine through which a web is passed, including a paper machine roll including a cylindrical metal frame, roll ends arranged at each end of the frame, shafts each coupled to a respective one of the roll ends, and a polymer coating applied to at least a central region of the frame between the roll ends, and a back-up roll arranged to form the nip with the coated central region of the paper machine roll such that the web is passed between the back-up roll and the coated central region of the paper machine roll, the coated central region of the paper machine roll being heated solely as a result of the formation of the nip with the back-up roll such that the coated central region is at a higher temperature than the roll ends and optionally uncoated lateral regions and heat is conducted from the coated central region to the roll ends and optionally uncoated lateral regions of the frame, the improvement comprising a heating arrangement arranged solely in the roll ends for heating the roll ends and the optionally uncoated lateral regions of the frame to thereby raise the temperature of the rolls ends and optionally uncoated lateral regions of the frame and reduce the temperature difference between the coated central region of the frame and the roll ends and the optionally uncoated lateral regions of the frame which would be formed during operation when the web passes through the nip, said heating arrangement comprising bores through which a heating medium is passed during use.

12. The roll of claim 11, wherein the polymer coating is applied only to the central region of the frame such that the lateral regions are uncoated.

13. The roll of claim 11, further comprising a bore arranged in each of the shafts through which the heating medium is passed into said bores of the heating arrangement.

* * * * *